US005145291A

United States Patent [19]

Bullivant

[11] Patent Number: 5,145,291

[45] Date of Patent: Sep. 8, 1992

[54] METHOD FOR FORMING A PILING BENEATH A STRUCTURE

[75] Inventor: Roger A. Bullivant, Newton Solney, England

[73] Assignee: Roger Bullivant of Texas, Inc., Grand Prairie, Tex.

[21] Appl. No.: 566,555

[22] Filed: Aug. 13, 1990

[51] Int. Cl.[5] ..... E02D 27/48

[52] U.S. Cl. ..... 405/230; 405/233; 52/742

[58] Field of Search ..... 405/230, 233, 229, 231, 405/234, 236; 52/742, 294

[56] References Cited

U.S. PATENT DOCUMENTS

| | | | |
|---|---|---|---|
| 4,548,526 | 10/1985 | Bullivant | 405/230 |
| 4,605,339 | 8/1986 | Bullivant . | |
| 4,618,289 | 10/1986 | Federer | 405/233 |
| 4,659,256 | 4/1987 | Bullivant | 405/230 |
| 4,735,527 | 4/1988 | Bullivant . | |
| 4,824,292 | 4/1989 | Bullivant . | |
| 4,834,582 | 5/1989 | Bullivant | 405/230 |
| 4,840,517 | 6/1989 | Bullivant . | |
| 4,906,140 | 3/1990 | Clark | 405/230 |

FOREIGN PATENT DOCUMENTS

| | | | |
|---|---|---|---|
| 796262 | 6/1958 | United Kingdom . | |
| 2068038 | 8/1981 | United Kingdom | 405/230 |
| 2091313 | 7/1982 | United Kingdom | 405/230 |
| 2094380 | 9/1982 | United Kingdom | 405/230 |
| 2126268A | 3/1984 | United Kingdom . | |

*Primary Examiner*—Michael Safavi
*Attorney, Agent, or Firm*—Richards, Medlock & Andrews

[57] ABSTRACT

A method of forming a pile and a method for supporting a building structure by utilizing a pile so formed comprises driving a pile casing (19), with an enlargement (24) near its leading end (20) to a desired depth and supplying under pressure a settable mixture through the top of the casing so that it flows through apertures (26) at the enlargement to fill the oversize hole left by the enlargement around the casing. The casing can be driven through a hole formed in the building structure to be supported and the settable mixture may flow up the pile casing to fill a void under the structure.

13 Claims, 3 Drawing Sheets

METHOD FOR FORMING A PILING BENEATH A STRUCTURE

TECHNICAL FIELD OF THE INVENTION

The present invention concerns improvements in or relating to piling methods, especially piling methods for existing buildings which, owing to subsidence, ground shrinkage, or the like, require additional support.

BACKGROUND OF THE INVENTION

There is disclosed in U.K. Patent No. 2091313 a method of underpinning structures using piles of relatively small diameter. This method has proved to be particularly successful but in certain circumstances the support provided by the piles requires augmentation. Such circumstances arise where a cavity appears beneath and around the foundation or footing of the building to be supported.

In the past, to support structures exhibiting this problem, it has been necessary to excavate down to a level beneath the bottom of the footing so that grout or concrete can be introduced into the cavity. For a domestic dwelling this is often inconvenient and expensive, and excavation work causes considerable disruption and mess.

It is an object of the present invention to obviate or mitigate these disadvantages.

SUMMARY OF THE INVENTION

According to the present invention there is provided a method of forming a pile comprising driving into the ground to a desired depth a hollow pile casing having an enlargement at or near its leading end whereby the hole formed in the ground by the casing behind said enlargement is greater in cross section than the external cross section of the casing, supplying a fluent settable mixture under pressure to the open top of the casing to pass down the casing to apertures formed through the casing in the upper side of said enlarged head and continuing to supply mixture to the casing so that it flows up the outside of the casing to fill the hole formed in the ground by the casing behind said enlargement and the casing.

Further, according to the present invention, there is provided a method for supporting a building comprising forming a passage through the building at an angle close to the vertical, driving through said passage to a desired depth a hollow pile casing having an enlarged leading end whereby the hole formed in the ground by the casing behind said enlargement is greater in cross-section than the external cross-section of the casing, supplying a fluent settable mixture under pressure to the open top of the casing to pass down the casing to apertures formed through the casing adjacent said enlarged head and continuing to supply mixture to the casing so that it flows up the outside of the casing to fill all spaces beneath the footing and said passage through the structure.

Preferably, the fluent settable mixture is a cementitious grout.

Preferably, as the casing is driven, said apertures are temporarily closed by closure means which resist the ingress of earth but is sufficiently weak to be ruptured by the pressure of the mixture.

Preferably, additional passages are formed through the structure at an angle greater than that at which the initial passage is formed, said additional passages accommodating grout or tie tubes being so arranged to resist any horizontal component of loading exerted by the structure.

Alternatively, the method includes forming an additional passage through the building spaced from the initial passage, said additional passage being arranged at a greater angle to the vertical than the initial passage, driving through said additional passage to a desired depth a hollow pile casing having an enlarged leading end whereby the hole formed in the ground by the casing behind said enlargement is greater in cross-section than the external cross-section of casing, supplying a fluent settable mixture under pressure to the open top of the casing to pass down the casing to apertures formed through the casing adjacent said enlarged head and continuing to supply mixture to the casing so that it flows up the outside of the casing to fill all spaces beneath the footing and said passage through the structure.

BRIEF DESCRIPTION OF THE DRAWINGS

An embodiment of the present invention will now be described by way of example only with reference to the accompanying drawings, in which.

DETAILED DESCRIPTION

Figure 1:
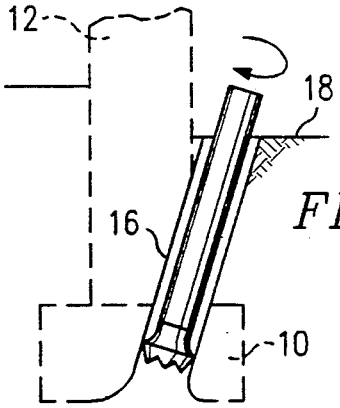
FIGS. 1 to 6 show diagrammatically a cross-section through the foundations of a structure to be supported and support means of various stages of installation.
Figure 2:
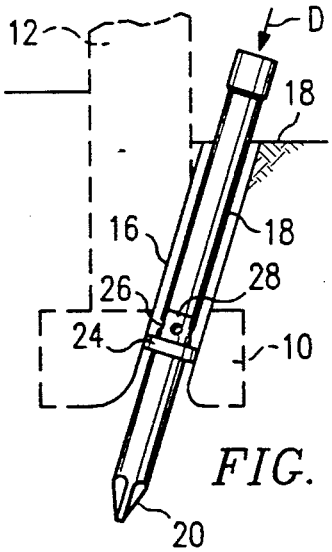
Figure 6:
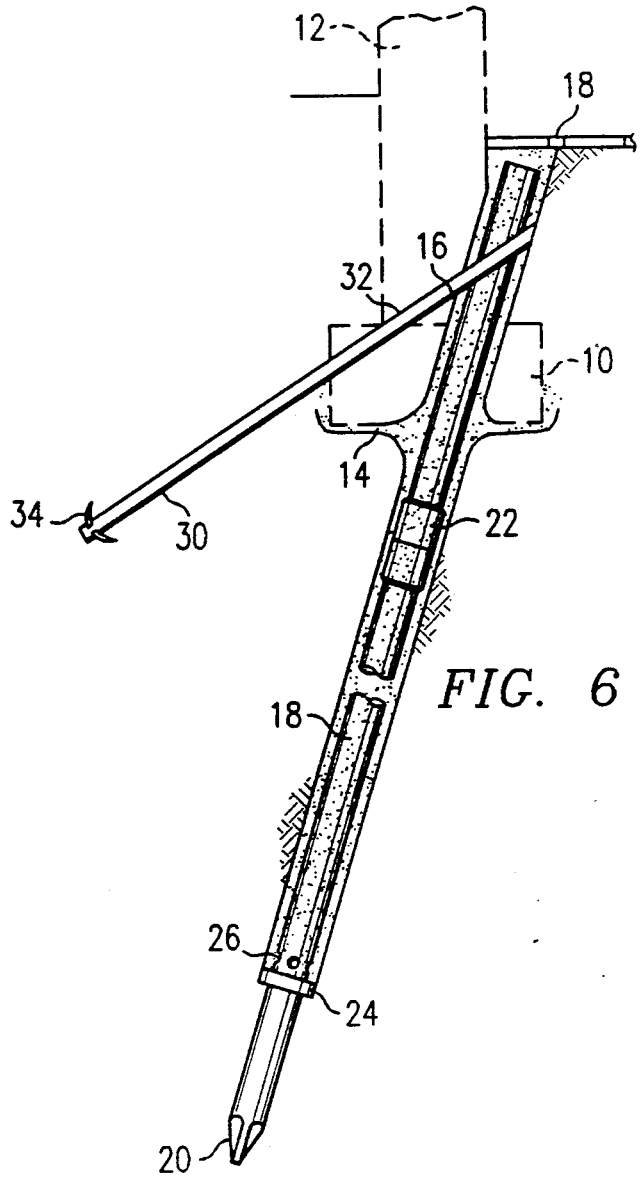

Referring to FIG. 1, a structure to be supported has a footing 10 supporting a brick or concrete wall 12. Owing to subsidence or ground shrinkage, a cavity 14 is formed beneath the footing 10. To support the structure, a first passage 16 is formed through the wall 12 and footing 10 at an angle which is close to the vertical (the angle to the vertical illustrated in the drawings being exaggerated for the purpose of illustration). The passage may be formed by a rotary percussive method by a drilling assembly 17, only the bit of which is shown, located at or near ground level 18, internally or externally of the structure. Referring to FIG. 2, a hollow pile casing 19 having a closed leading end 20 has a continuous peripheral protrusion 24 fixed thereto adjacent to its leading end but spaced therefrom by a distance sufficient to enable the leading end to direct the pile in the chosen direction without substantial deviation, (for example 500 mm). The external diameter of the protrusion is substantially equal to the internal diameter of the passage 16 through the structure. On the side of the protrusion 24, remote from the leading end 20 of the casing there is provided a plurality of apertures 26 passing through the casing, and normally sealed off by a rupturable material, conveniently an adhesive tape 28 (FIGS. 2 and 6). The casing may be or bottom driven, in the direction of arrow D in FIG. 2 for example, by a soil displacement mole or by a conventional mobile vibratory or impact pile driving assembly. The casing may be provided in a plurality of interconnected sections joined by interconnection means 22. Thus, the method of driving the casing is similar to that described in U.K. Patent 2091313.

Figure 3:
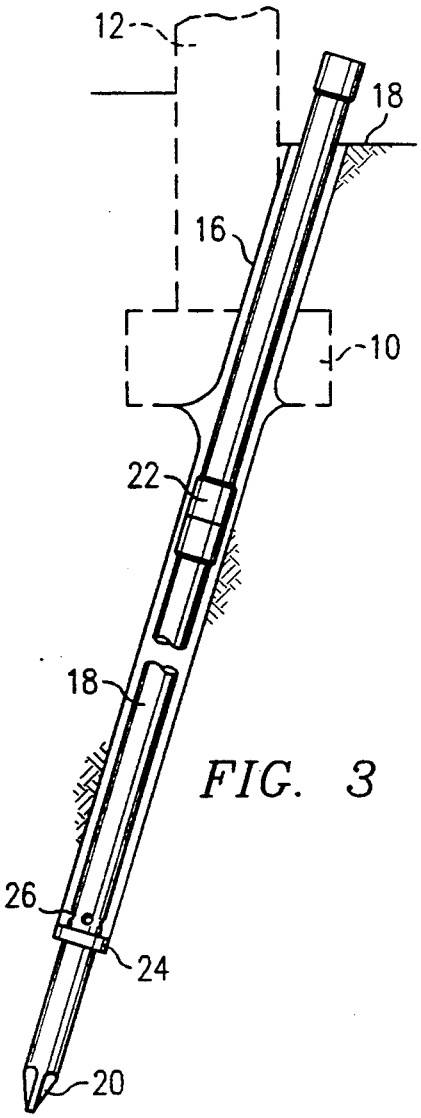
Figure 4:
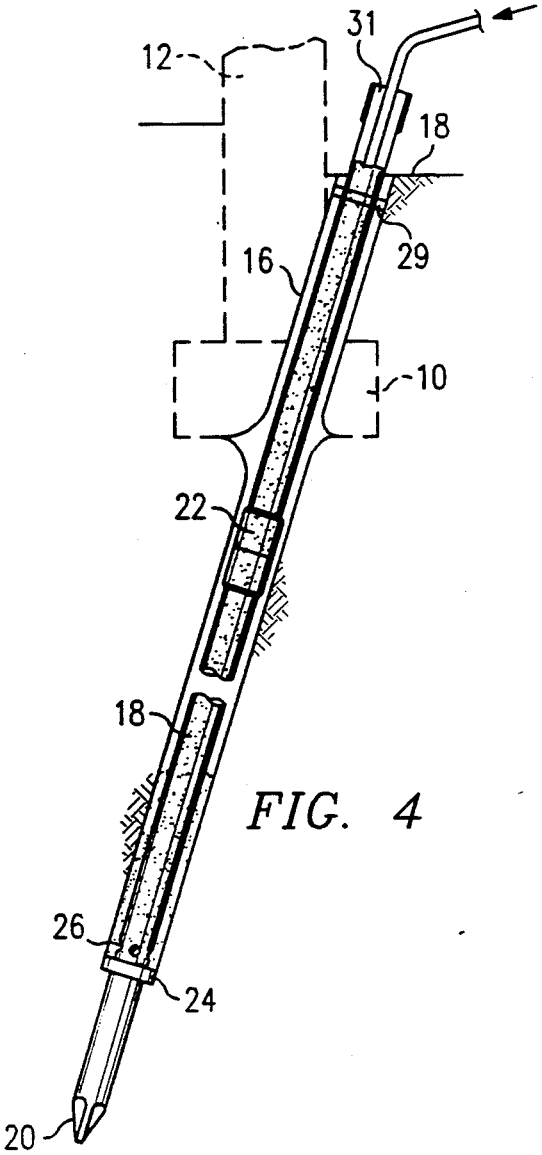
Figure 5:
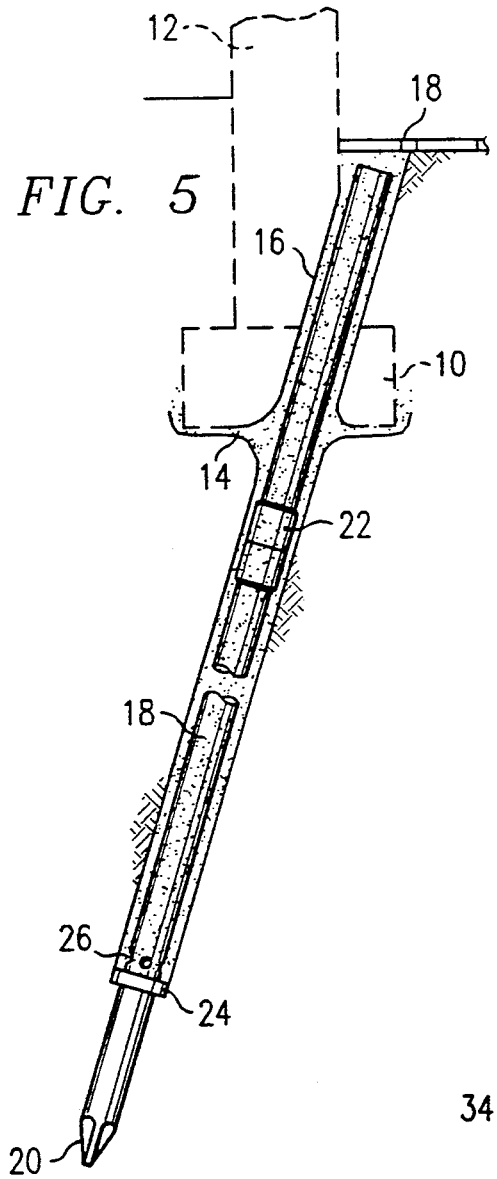

Referring to FIG. 3, the pile has been driven to a sufficient depth, normally when its top approaches or reaches ground level. The space between the casing 19 and the passage can then be sealed by an inflatable annulus 29 as shown in FIG. 4, and a fluent cementitious mix or grout is passed under pressure into the casing through a filing assembly 31 and passes down through the casing to the apertures 26 at which stage the covering tape 28 is ruptured, allowing the grout to pass up the hole formed by the protrusion 24 to fill the hole created by the casing, the cavity 14, and the passage 16 thereby bonding the casing to the structure as well as filling the cavity. The excess casing at its top can then be cut off at or below ground level, as shown in FIG. 5.

In view of the fact that the casing is driven at an angle to the vertical, albeit a small angle, and the fact that the footing 10 may not be fully supported against transverse movement due, for example, to the cavity, one or more grout or tie tubes 30, as shown in FIG. 6, may also be provided. Each tube is positioned by forming a further passage through the wall 12 and footing 10, again preferably by a rotary percussive drilling method carried out by a drilling machine supported at or near ground level. The angle of the further passage 32 through the structure is closer to horizontal than the angle of the first passage 16. After it has been driven, a tie or grout tube may be passed through the further passage and driven, into the ground for a depth sufficient to give the required resistance to the horizontal component of movement. The tie or grout tube augments any horizontal resistance given by the grout filling the cavity 14 and may take any convenient form, for example, a concrete member either precast or formed in situ, a metal bar or a ground tie including a duck bill anchorage 34 at its leading end. The duck bill anchorage comprises a plurality of plates hingedly mounted to the tie bar, the hinges being located at the leading end of the bar so that on attempting to withdraw the bar after it has been positioned the plates hinge outwardly to form an anchorage.

It will be realized that the operations described above can be repeated at intervals along the structure, in some instances alternatively from the outside and the inside of the structure but normally from the outside only.

Figure 7:
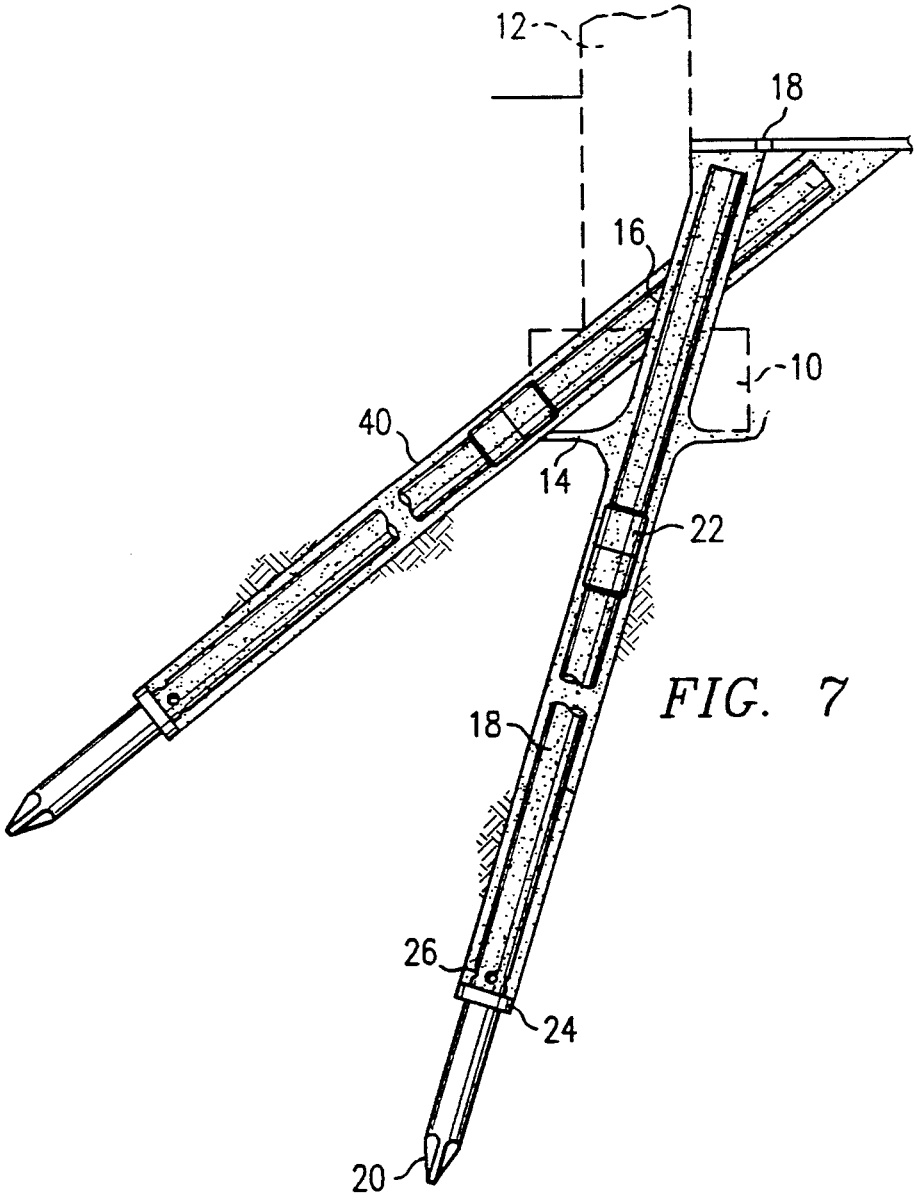
FIG. 7 shows a view similar to FIGS. 5 and 6 of a modification.

In the modification shown in FIG. 7 the first pile casing is positioned and driven in the manner described above with reference to FIG. 1 and an additional similar pile is driven through a second passage 40 spaced from the first passage along the structure but at a greater angle to the vertical (again the angle illustrated in the drawing being exaggerated for illustrative purposes). The second pile is intended to restrain the horizontal components of any active loading on the building and by utilizing the method described above, the additional pile serves also to supply grout to the cavity 14 below the structure. All piling operations are carried out from the exterior of the building and the pairs of piles are repeated, at spaced intervals, around the periphery of the building.

Various other modifications can be made without departing from the scope of the invention. In one modification, the pile hole may be formed by an augering method but in most circumstances the soil displacement method referred to above is most advantageous.

It must be realized that most structures requiring support are in a relatively delicate condition. The method of this invention utilizes relatively gentle passage forming the pile driving methods which, by use of small diameter casings (typically 90 mm. diameter) gives the effect of a 140 mm. diameter pile, without disturbing the structure.

The present invention also relates to a method of forming a pile utilizing the pile casings described with reference to FIGS. 1 and 2. The method of forming the pile is exactly the same as that described above, except that the pile is driven directly into the ground to be piled that is without having first being passed through a pre-formed passage in a building structure.

I claim:

1. A method for supporting a building with at least one pile formed by a hollow pile casing, said casing having an open proximal end, an enlarged head at or near its distal end, and at least one aperture formed on the proximal side of said enlarged head, comprising:

(a) forming a passage through the building at an angle close to vertical;

(b) rupturably sealing said at least one aperture with closure means;

(c) driving through said passage to a desired depth the hollow pile casing, said enlarged head forming a hole in the ground of greater cross-sectional area than the cross-sectional area of said casing;

(d) supplying a fluent settable mixture under pressure to the open proximal end of said casing, said mixture passing through the casing to the apertures;

(e) rupturing the closing means with said fluent settable mixture;

(f) continuing to supply mixture to the casing so that it flows into the annulus outside the casing to a predetermined height; and (g) cutting off the proximal end of said casing at ground level.

2. The method of claim 1, wherein said step of rupturably sealing comprises wrapping adhesive tape around said casing and over said apertures.

3. The method of claim 1, further comprising:

(h) forming at least one additional passage through the building adjacent with initial passage at an angle greater than that at which the initial passage is formed.

4. The method of claim 1, further comprising:

(i) driving at least one additional hollow pile casing with rupturably sealed apertures into said additional passage; and (j) repeating steps (d)–(g) on said at least one additional hollow pile casings.

5. A method of forming a pile comprising:

(a) driving into ground to a desired depth a hollow pile casing having an enlarged head at or near its leading end and at least one aperture above said enlarged head, whereby a hole is formed in the ground by the casing behind said enlarged head that is greater in cross-section than the external cross-section of the casing;

(b) supplying a fluent settable mixture under pressure to the open top of the casing to pass down the casing to said at least one aperture;

(c) rupturably sealing said at least one aperture by closure structure while the casing is driven, said closure structure resisting the ingress of earth but rupturable by the pressure of the mixture; and (d) continuing to supply the mixture to the casing so that it flows through said at least one aperture and up the outside of the casing to fill the hole formed in the ground by the casing behind said enlarged head of the casing.

6. The method of claim 5, in which the fluent settable mixture is a cementitious grout.

7. A method of forming a pile using a hollow pile casing with an open proximal end, an enlarged head at or near its distal end and at least one aperture formed on the proximal side of said enlarged head comprising:

(a) rupturably sealing said at least one aperture with closure means;

(b) driving the hollow pile casing into the ground at an angle close to vertical and to a desired depth, said enlarged head forming a hole in the ground of greater cross-sectional area than the cross-sectional area of said casing;

(c) supplying a fluent settable mixture under pressure to the open proximal end of said casing, said mixture passing through the casing to the apertures;

(d) rupturing the closure means with said fluent settable mixture;

(e) continuing to supply mixture to the casing so that it flows into the annulus outside the casing to a predetermined height; and (f) cutting of the proximal end of said casing at ground level.

8. The method of claim 7 wherein, said step of rupturably sealing comprises wrapping adhesive tape around said casing and over said apertures.

9. The method of claim 7, further comprising:

(g) driving at least one additional hollow pile casing with rupturably sealed apertures into the ground adjacent said initial hollow pile casing and at an acute angle to said initial pile casing; and (h) repeating steps (c)–(f) on said additional hollow pile casing.

10. A method for supporting a building comprising:

(a) forming a passage through the building at an angle close to the vertical;

(b) driving through said passage to a desired depth a hollow pile casing having an enlarged leading end and at least one aperture above said enlarged leading end, whereby a hole is formed beneath the building by the casing behind said enlarged leading end that is greater in cross-section than the external cross-section of the casing;

(c) supplying a fluent settable mixture under pressure to the open top of the casing to pass down the casing to said at least one aperture;

(d) rupturably sealing said at least one aperture by closure structure while the casing is driven into the hole, said closure structure resisting the ingress of earth but rupturable upon application of pressure by the mixture; and (e) continuing to supply the mixture to the casing so that it flows through said at least one aperture and up the outside of the casing to fill the hole beneath the building and said passage through the building.

11. The method of claim 10, in which the fluent settable mixture is a cementitious grout.

12. The method of claim 10, further comprising the step of:

(f) forming through the building an additional passage at an angle greater than that at which the initial passage is formed, said additional passage accommodating a tie tube and being so arranged to resist any horizontal component of loading exerted by the building.

13. The method of claim 10, further comprising the steps of:

(f) forming through the building an additional passage;

(g) driving through said additional passage to a desired depth an additional hollow pile casing having an enlarged leading end and at least one aperture above said enlarged leading end, whereby an additional hole is formed beneath the building by the additional casing behind said enlarged leading end that is greater in cross-section than the external cross-section of the additional casing;

(h) supplying a second fluent settable mixture under pressure to the open top of the additional casing in said additional passage to pass down the additional casing to said at least one aperture so that it flows up the outside of the additional casing to fill the additional hole beneath the building and said additional passage through the building; and (i) rupturably sealing said at least one aperture of the additional casing by second closure structure while the additional casing is driven into the additional hole, said second closure structure resisting the ingress of earth but rupturable upon application of pressure by the second mixture.

* * * * *